US009584909B2

(12) United States Patent
Heusdens et al.

(10) Patent No.: US 9,584,909 B2
(45) Date of Patent: Feb. 28, 2017

(54) DISTRIBUTED BEAMFORMING BASED ON MESSAGE PASSING

(71) Applicant: Google Inc., Mountain View, CA (US)

(72) Inventors: Richard Heusdens, Delft (NL); Guoqiang Zhang, Delft (NL); Richard Hendriks, Delft (NL); Yuan Zeng, Delft (NL); Willem Bastiaan Kleijn, Lower Hutt (NZ)

(73) Assignee: Google Inc., Mountain View, CA (US)

( * ) Notice: Subject to any disclaimer, the term of this patent is extended or adjusted under 35 U.S.C. 154(b) by 983 days.

(21) Appl. No.: 13/867,814

(22) Filed: Apr. 22, 2013

(65) Prior Publication Data

US 2015/0200454 A1 Jul. 16, 2015

Related U.S. Application Data

(60) Provisional application No. 61/645,478, filed on May 10, 2012.

(51) Int. Cl.
*H01Q 3/00* (2006.01)
*H04R 3/00* (2006.01)
(Continued)

(52) U.S. Cl.
CPC ..... *H04R 3/005* (2013.01); *G10L 21/0364* (2013.01); *G10L 2021/02166* (2013.01); *H04R 2420/07* (2013.01)

(58) Field of Classification Search
CPC ..... H01Q 3/00; H04R 3/005; H04R 2420/07; G01L 21/0364; G01L 2021/02168
(Continued)

(56) References Cited

U.S. PATENT DOCUMENTS

2005/0213778 A1* 9/2005 Buck ..... H04R 3/005 381/94.3
2006/0222184 A1* 10/2006 Buck ..... G10L 21/0208 381/71.1
(Continued)

OTHER PUBLICATIONS

A. Bertrand and M. Moonen, "Distributed adaptive node-specific signal estimation in fully connected sensor networks—part 1: Sequential node updating," IEEE Trans. Signal Processing, vol. 58, No. 10, pp. 5277-5291, Oct. 2010.
(Continued)

*Primary Examiner* — Harry Liu
(74) *Attorney, Agent, or Firm* — Brake Hughes Bellermann LLP

(57) ABSTRACT

Methods and systems are provided for implementing a distributed algorithm for beam-forming (e.g., MVDR beam-forming) using a message-passing algorithm. The message-passing algorithm provides for computations to be performed in a distributed manner across a network, rather than in a centralized processing center or "fusion center". The message-passing algorithm may also function for any network topology, and may continue operations when various changes are made in the network (e.g., nodes appearing, nodes disappearing, etc.). Additionally, the message-passing algorithm may minimize the transmission power per iteration and, depending on the particular network, also may minimize the transmission power required for communication between network nodes.

17 Claims, 3 Drawing Sheets

$$\tilde{x}_j^{(k)} = \arg\min_{x_j}\left(f_j(x_j) + \sum_{u\in N(j)} \mathrm{Re}(m^{(k)}_{u\to j}(x_j))\right)$$

(51) Int. Cl.
*G10L 21/0364* (2013.01)
*G10L 21/0216* (2013.01)

(58) Field of Classification Search
USPC ..... 342/377
See application file for complete search history.

(56) References Cited

U.S. PATENT DOCUMENTS

2010/0245624 A1* 9/2010 Beaucoup ..... H04N 5/772
348/231.4
2012/0224714 A1* 9/2012 Couse ..... H04R 1/406
381/92
2012/0327115 A1* 12/2012 Chhetri ..... H04R 3/005
345/633
2014/0064514 A1* 3/2014 Mikami ..... G10L 21/0208
381/86

OTHER PUBLICATIONS

A. Bertrand and M. Moonen, "Distributed node-specific LCMV beamforming in wireless sensor networks," IEEE Transactions on Signal Processing, vol. 60, No. 1, pp. 233-246, Jan. 2012.
G. Zhang and R. Heusdens, "Liner coordinate-descent message-passing for quadratic optimization," in IEEE Int. Conf. Acoust., Speech, Signal Processing, Mar. 2012, pp. 2005-2008.
Y. Zeng and R.C. Hendriks, "Distributed delay and sum beamformer for speech enhancement in wireless sensor networks via randomized gossip," in IEEE Int. Conf. Acoust., Speech, Signal Processing, Mar. 2012, pp. 4037-4040.

* cited by examiner $$\tilde{x}_j^{(k)} = \arg\min_{x_j}\left(f_j(x_j) + \sum_{u\in N(j)} \mathrm{Re}\left(m_{u\to j}^{(k)}(x_j)\right)\right)$$

DISTRIBUTED BEAMFORMING BASED ON MESSAGE PASSING

The present application claims priority to U.S. Provisional Patent Application Ser. No. 61/645,478, filed May 10, 2012, the entire disclosure of which is hereby incorporated by reference.

TECHNICAL FIELD

The present disclosure generally relates to systems and methods for signal processing. More specifically, aspects of the present disclosure relate to distributed processing techniques for use in sensor networks.

BACKGROUND

Specific sound sources can be extracted from a set of microphone signals by means of beam-forming. To be able to deal with a wide range of scenarios, it is desirable to perform beam-forming using a subset of an unlimited number of microphones, and to organize these microphones by means of wireless communication.

To make such a system practical and scalable, the computations should be performed in a distributed manner across the network, rather than in a centralized processing center or "fusion center." One algorithmic approach performs distributed processing but requires that all the nodes in the network be able to communicate to each other. As a result, the approach is not scalable nor does it allow for implementation in an arbitrary topology. Such an approach is therefore not practical for large systems.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

One embodiment of the present disclosure relates to a system comprising a plurality of sensors in communication over a network, the plurality of sensors configured to extract a plurality of acquired signals from a subset of the sensors, the acquired signals being for computing parameters of a beam-forming algorithm, wherein the parameters of the beam-forming algorithm are computed in a distributed fashion over the plurality of sensors based on transmission of messages between the plurality of sensors according to a message-passing procedure.

In another embodiment, the system further comprises a self-calibration component configured to determine locations of the plurality of sensors.

Another embodiment of the present disclosure relates to a method comprising: extracting, by a plurality of sensors in communication over a network, acquired signals from a subset of the sensors; and computing parameters of a beam-forming algorithm using the acquired signals, wherein the parameters of the beam-forming algorithm are computed in a distributed fashion over the plurality of sensors based on transmission of messages between the plurality of sensors according to a message-passing procedure.

In one or more other embodiments, the systems and methods described herein may optionally include one or more of the following additional features: the message-passing procedure functions for any topology of the network; the message-passing procedure that functions for any topology of the network is a generalized linear-coordinate descent (GLiCD) algorithm; the beam-forming algorithm is a minimum variance distortionless response (MVDR) beam-former; the beam-forming algorithm is a delay-sum beam-former; the beam-forming algorithm is an algorithm having an adjustable parameter with a continuous range of settings, the continuous range of settings including a minimum variance distortionless response (MVDR) beam-former; the continuous range of settings further includes a delay-sum beam-former; the adjustable parameter controls a weighting of off-diagonal elements of a sensor noise covariance matrix; the plurality of sensors are in one or more predetermined locations; and/or the plurality of sensors includes microphones and processors.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
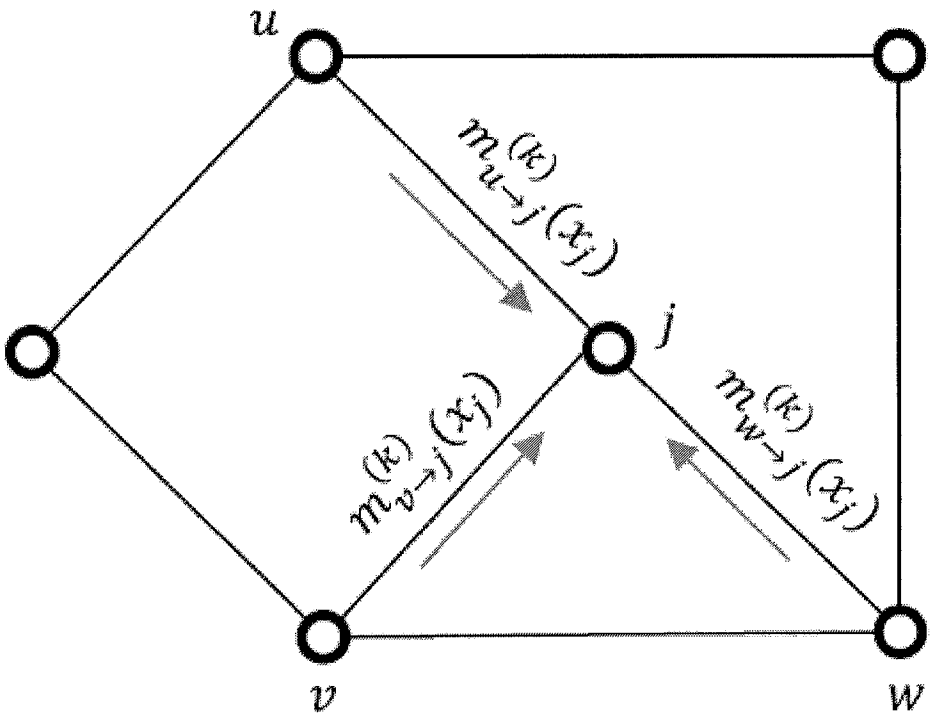
FIG. 1 is a functional diagram illustrating an example message-passing algorithm according to one or more embodiments described herein.

The headings provided herein are for convenience only and do not necessarily affect the scope or meaning of the claimed embodiments.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments will now be described. The following description provides specific details for a thorough understanding and enabling description of these examples and embodiments. One skilled in the relevant art will understand, however, that the various embodiments described herein may be practiced without many of these details. Likewise, one skilled in the relevant art will also understand that the various embodiments described herein can include many other obvious features not described in detail herein. Additionally, some well-known structures or functions may not be shown or described in detail below, so as to avoid unnecessarily obscuring the relevant description.

Embodiments of the present disclosure relate to methods and systems for implementing a distributed algorithm for MVDR beam-forming using generalized linear-coordinate descent (hereafter referred to as "GLiCD") message-passing operations.

As will be further described herein, the GLiCD message-passing algorithm provides for computations to be performed in a distributed manner across a network, rather than in a centralized processing center or "fusion center." The GLiCD message-passing algorithm may also function for any network topology, and may continue operations when various changes are made in the network (e.g., nodes appearing, nodes disappearing, etc.). Additionally, the GLiCD message-passing algorithm may minimize the transmission power per iteration (e.g., since only one parameter must be transmitted, as further explained below) and, depending on the particular network, also may minimize the transmission power required for communication between network nodes.

The message-passing algorithm of the present disclosure may perform GLiCD operations to exchange messages between neighboring microphone nodes, which converges increasingly fast as the noise correlation matrix becomes more and more diagonal. The algorithm may make use of a trade-off parameter that controls the off-diagonal energy of the noise correlation matrix. In the case where the noise correlation matrix is truly diagonal, the performance of the GLiCD algorithm may be considered equivalent to that of the delay-and-sum beamformer (DSB). As will be described in greater detail herein, the message-passing algorithm does not require any constraint on the network topology, is fully scalable, and can exploit sparse network geometries, thereby making it suitable for distributed signal processing in large scale networks.

1. Introduction

A major concern with many speech processing applications is speech intelligibility when the application is applied in noisy environments. For example, consider the use of mobile telephones or hearing aids in noisy environments such as a cocktail party or a train station. Many hearing aids and mobile telephones are equipped with multiple microphones, which make it possible to incorporate spatial selectivity in the system by constructing a beam pointing in the direction of interest. More generally, by using near-field beam forming, point sources located in particular regions of a physical space can be amplified over noise and other point sources. This is an effective way to improve both speech quality and speech intelligibility in such noisy environments. However, due to space and power limitations, for many applications the number of microphones is limited to two or three.

Developments in the area of wireless sensors enable the construction of wireless microphone networks (WMNs) consisting of a large number of nodes, each having a sensing component (e.g., a microphone), a data processing component, and a communication component. In such networks, due to the absence of a central processing point (e.g., central processor or "fusion center"), nodes use their own processing ability to locally perform simple computations and transmit only the required and partially-processed data to neighboring nodes. The decentralized and asynchronous settings in which speech enhancement algorithms then have to be deployed are typically dynamic, in the sense that sensors are added or removed, usually in an unpredictable manner. In those settings, speech enhancement algorithms should allow for a parallel implementation, should be easily scalable, should be able to exploit the possible (large) sparse geometry in the problem, and should be numerically robust against (small) changes in the network topology.

Under one approach, an algorithm for distributed minimum mean-squared error (MMSE) estimation of a specific target signal can be extended to a distributed beamformer. The centralized estimator can be approximated by computing iteratively, per sensor, a beamformer involving only those signals that the microphone can obtain from its neighboring nodes computed during the previous iteration. However, this approach requires fully-connected networks or networks with a tree topology. Further, at every iteration in this approach, each node needs to re-estimate the correlation matrix in order to estimate the optimal beamformer coefficients. Such requirements limit the applicability of this approach to large scale sensor networks.

Another approach provides for a generalization of a distributed delay-and-sum beamformer (DSB) based on randomized gossiping. As compared to the previous approach described above, which is distributed but requires a fully-connected network, the algorithm of this second approach does not require a fully-connected network nor does it compute the result of the centralized beamformer iteratively. Instead, this second approach computes the parameters needed to compute the centralized estimator in a distributed iterative manner. When the WMN is connected, the algorithm converges to the centralized beamformer using only local information without any network topology constraint. Therefore, this distributed beamformer may be considered scalable and robust against dynamic networks. However, for the distributed beamformer provided under this second approach it was assumed that the noise is uncorrelated across microphones, with the possibility of having a different power spectral density (PSD) per microphone. This constraint limits performance, since in practice acoustical noise will be correlated across multiple microphones when the microphones are placed in the vicinity of each other. Taking these noise correlations across microphones into account (e.g., by computing a distributed minimum variance distortionless response (MVDR) beamformer) requires the challenging distributed computation of the inverse of a matrix (for each frequency bin).

As will be further described below in connection with the various embodiments of the present disclosure, the distributed delay-and-sum beamformer of the second approach presented above is extended to a fully-distributed MVDR beamformer. To achieve this, a distributed message-passing algorithm is used to compute the inverse of a matrix. The message-passing algorithm performs GLiCD operations to exchange messages between neighboring microphone nodes. As the noise correlation matrix becomes more diagonal, the GLiCD algorithm converges increasingly fast. In a scenario where the noise correlation matrix is truly diagonal, the performance of the GLiCD algorithm may be considered to be equivalent to that of the DSB.

The GLiCd algorithm described herein does not need to estimate the noise correlation matrix at every iteration, as required in some other approaches. Instead, the MVDR beamformer may be solved directly in a distributed fashion and it is only necessary to estimate the noise correlation at the beginning. The messages of the GLiCD algorithm spread the information about the noise correlation to every microphone needed to implement the MVDR beamformer. In addition, the GLiCD algorithm described herein does not require any constraint on the network topology, thereby making it very suitable for distributed signal processing in large scale networks.

2. Notation and Assumptions

The sections that follow provide details regarding various features of the GLiCD algorithm in accordance with embodiments of the present disclosure. The following description considers a WMN of n microphones whose signals are windowed and transformed to the spectral domain using a discrete Fourier transform (DFT). The description also assumes the presence of a single target source degraded by acoustical additive noise uncorrelated with the source.

Let $[Y=Y_1, \ldots, Y_n]^t$, where $(\bullet)^t$ indicates matrix transposition, denote a vector containing the stacked noisy DFT coefficients for each of the n microphones for a particular time frame and frequency bin (the following description also makes the approximation that DFT coefficients are independent across time and frequency, and therefore time and frequency indices are not considered for ease of notation). Similarly, N, $d \in C^n$ may be defined as the vector containing noise DFT coefficients and the (frequency dependent) propagation vector, respectively. The following description also assumes that d is given. In practice, d may be estimated and adapted using any suitable method known to those skilled in the art. In addition, it may be assumed that a global timing is available, for example, by broadcast. With this, the clean-speech contribution at microphone j can be expressed as $Sd_j$, where S denotes the target speech DFT coefficient. Hence, the noisy speech DFT coefficients are given by the following:

$$Y=Sd+N$$

To estimate the target DFT coefficient S, a spatial filter w can be applied to the noisy DFT coefficients, thus leading to an estimate of the clean speech signal $\hat{S}=w^*Y$, where $(\bullet)^*$ indicates Hermitian transposition. One particular choice of the filter coefficients may be obtained by minimizing the expected power of the output $\hat{S}$ under the constraint that the target source is undistorted, for example, $$\min_w w * R_Y w, \quad \text{subject to } w * Sd = S \tag{1}$$

leading to the so-called MVDR beamformer, where $R_Y=E[YY^*]$ is the auto-correlation matrix of the random vector Y and E denotes the expectation operator. Solving equation (1) and using the matrix inversion lemma, it can be shown that $$w_{MVDR} = \frac{R_N^{-1} d}{d * R_N^{-1} d}. \tag{2}$$

The DSB simplifies the above equation (2), where $R_N=E[NN^*]$, by setting all of the off-diagonal elements in $R_N$ to be zero. By doing so, the computation of the matrix inversion is avoided at the cost of degraded performance compared to that of the MVDR. With the above insight, it is natural to introduce a trade-off parameter, for example, to adjust the off-diagonal elements of $R_N$ as $$R_N'=(1-\gamma)R_N+\gamma \mathrm{diag}(\sigma_{N_1}^2, \ldots, \sigma_{Nn}^2), \tag{3}$$

where $\sigma_{Nj}^2=E[N_jN_j^*]$, the jth diagonal element of $R_N$. Correspondingly, equation (2) can be generalized to the following:

$$w_\gamma = \frac{R_N'^{-1} d}{d * R_N'^{-1} d}, \tag{4}$$

where $\gamma=0$ corresponds to the MVDR solution and $\gamma=1$ results in the DSB solution. The parameter $\gamma$ introduced in equation (3) can thus be used to balance the beamformer performance and computation complexity.

3. Distributed Computation of MVDR Beamformer

The following section considers computing $\hat{S}_\gamma=w_\gamma^*Y$ in a distributed fashion. It is assumed that the noise-correlation matrix $R_N$ is known a-priori. In practice, the correlation matrix must be estimated using, for example, any suitable method known in the art.

3.1. Computational Framework

The computation of $\hat{S}_\gamma$ may be performed in two steps. First, $z=R_N'^{-1}d$ is computed, after which $\hat{S}_\gamma$ is obtained by the following:

$$\hat{S}_\gamma = \frac{z * Y}{z * d} \tag{5}$$

It should be noted that both $R_N'$ and d are complex values. Equation (5) can be implemented using suitable randomized gossip algorithms known in the art. Accordingly, the sections that follow focus on computing $z=R_N'^{-1}d$.

It is assumed, without loss of generality, that the correlation matrix has unit-diagonal elements by resealing the variables. Let $T=\mathrm{diag}(\sigma_{N_1}^{-1}, \ldots, \sigma_{Nn}^{-1})$ be a matrix that is used to normalize to rescale the correlation matrix. Rather than computing z directly, first the auxiliary variable $\tilde{x}$ is computed:

$$\tilde{x}=J^{-1}h \tag{6}$$

where $J=TR_N'T$ and $h=Td$. Note that the matrix J is of unit-diagonal. Once $\tilde{x}$ is obtained, the vector z can be computed straightforwardly as $z=T\tilde{x}$ since T is diagonal.

The approach described herein is based on the observation that the solution in equation (6) is the maximum a posteriori (MAP) estimate of a random vector $x \in C^n$ with circularly symmetric complex Gaussian distribution $$p(x) \propto e^{-\frac{1}{2}x^* Jx + Re(h^* x)}, \tag{7}$$

where $J \succ 0$ is a Hermitian positive definite matrix and h is the potential vector. Finding the MAP estimate is a probabilistic inference problem and can be solved using message-passing algorithms such as, for example, (loopy) Gaussian belief propagation (GaBP).

To overcome numerical problems with products of small probabilities, it is convenient to work with the logarithm of the joint distribution. As a consequence, finding the MAP estimate of x is similar to solving the following quadratic optimization problem:

$$\min_{x \in C^n} f(x) \triangleq \frac{1}{2} x * Jx - \mathrm{Re}(h * x) \tag{8}$$

The off-diagonal elements of J correspond to partial correlation coefficients. The fill pattern of J therefore reflects the Markov structure of the Gaussian distribution in the sense that p(x) is Markov with respect to the graph G=(V,E) where V={1, . . . , n} denotes the vertex set and E={(i,j)|$r_{ij}\neq 0$} the set of edges representing the connections between the nodes.

By the Hammersley-Clifford theorem, the quadratic function $f(x)$ can be decomposed in a pairwise fashion according to pairwise cliques of G, that is $$f(x)=\sum_{i\in V} f_i(x_i)+\sum_{(i,j)\in E} f_{ij}(x_i,x_j) \tag{9}$$

where the local objective functions $f_i$ and $f_{ij}$ are called the node and edge potential functions, respectively. As a result, the minimization problem (8) can be solved iteratively using GaBP, in which case the algorithm is referred to as the min-sum algorithm. In particular, at iteration k, each node j keeps track of messages $m_{u\to j}^{(k)}(x_j)$ from each neighbor $u\in N(j)\triangleq\{i\in V:(i,j)\in E\}$. Incoming messages are combined to compute new outgoing messages and an estimate $\tilde{x}_j^{(k)}$ of the optimal solution $\tilde{x}$ is computed as $$\tilde{x}_j^{(k)}=\underset{x_j}{\operatorname{argmin}}\left(f_j(x_j)+\sum_{u\in N(j)}\operatorname{Re}\left(m_{u\to j}^{(k)}(x_j)\right)\right),\ j\in V.$$

The algorithm converges if $$\lim_{k\to\infty}\tilde{x}^{(k)}=\tilde{x},$$

where $$\tilde{x}^{(k)}=\left(\tilde{x}_1^{(k)},\ \ldots\ ,\tilde{x}_{|V|}^{(k)}\right)^t.$$

FIG. 1 illustrates the message-passing algorithm in accordance with at least one embodiment of the present disclosure. At iteration k, node j receives messages from all of its neighbors (e.g., nodes u, v, and w, in the context of the present example), which are used to make an estimate $\tilde{x}_j^{(k)}$ of the optimal solution $\tilde{x}_j$. At the same time, new messages are computed to be sent out at the next iteration. This procedure is executed in each and every node $i\in V$.

It has been shown that, if the min-sum algorithm converges, it computes the global minimum of the quadratic function. A convergence condition has been established where the information matrix J is required to be diagonally dominant. Furthermore, a walk-summable framework for pairwise quadratic graphical models shows that the algorithm converges if $\rho(|K|)<1$ with K=J−I, $\rho(\bullet)$ denotes the spectral radius, defined as $\rho(A)=\max_i|\lambda_i|$, where $\lambda_1,\ldots,\lambda_n$ are the n real or complex eigenvalues of $A\in C^{n\times n}$, and if $A,B\in C^{n\times n}$ then $B=|A|\Rightarrow b_{ij}=|a_{ij}|$ for all i,j=1, . . . , n.

Since the local objective functions are quadratic, the messages in the min-sum algorithm are quadratic as well and can, therefore, be parameterized by two parameters. In the present WMN setting, this means that at every iteration each node transmits two parameters to neighboring nodes. In order to reduce the number of parameters to be passed between nodes, iterative methods can be used that transmit only one parameter per iteration to neighboring nodes. One such example is the Jacobi algorithm, which converges if $\rho(|K|)<1$. However, although being attractive because of its simplicity, the Jacobi algorithm is known to converge slowly, even when used with a relaxation parameter.

3.2. The GLiCD Algorithm

To overcome the problems described in the sections above, the GLiCD algorithm, in accordance with one or more embodiments of the present disclosure, is introduced to minimize equation (9). The GLiCD algorithm is a message-passing algorithm where messages are a linear function of the node variables, while still having convergence properties comparable to the min-sum algorithm. This means that instead of transmitting two parameters, only one parameter must be transmitted per iteration, thereby saving approximately 50% of the transmit power. Additional details regarding the GLiCD algorithm are described in the sections below.

The GLiCD algorithm defines messages as $m_{u\to j}^{(k)}(x_j)=-\bar{z}_{uj}^{(k)}x_j$, where $(\bar{\bullet})$ denotes complex conjugation. With this, the estimate $\tilde{x}_j^{(k)}$ of $\tilde{x}_j$ becomes $$\tilde{x}_j^{(k)}=h_j+\sum_{u\in N(j)} z_{uj}^{(k)}$$

The messages are designed in a way that, upon receiving a new message from node $i\in N(j)$, a new estimate of $\tilde{x}_j$, denoted by $\tilde{x}_{j|i}^{(k+1)}$, is made as the following:

$$\tilde{x}_{j|i}^{(k+1)}=h_j+\sum_{u\in N(j)\setminus i} z_{uj}^{(k)}+z_{ij}^{(k+1)} \tag{10}$$

such that the pair $(\tilde{x}_{i|j}^{(k+1)},\tilde{x}_{j|i}^{(k+1)})$ minimizes a local cost function $L_{ij}^{(k)}(x_i,x_j)$. The subscripts i|j and j|i indicate that the estimates of $\tilde{x}_i$ and $\tilde{x}_j$ are only based on information of node j and i, respectively. Thus, at iteration (k+1), |N(j)| estimates are obtained of $\tilde{x}_j$ at node j, one for each neighboring node, which all should converge to the same value $\tilde{x}_j$.

It has been shown that $$z_{ij}^{(k+1)}=\frac{\omega|J_{ij}|^2}{1-\omega^2|J_{ij}|^2}\left(\omega h_j+\omega\sum_{v\in N(j)\setminus i} z_{vj}^{(k)}+(1-\omega)\tilde{x}_{j|i}^{(k)}\right)-\frac{J_{ij}}{1-\omega^2|J_{ij}|^2}\left(\omega h_j+\omega\sum_{u\in N(i)\setminus j} z_{uj}^{(k)}+(1-\omega)\tilde{x}_{i|j}^{(k)}\right)$$

where $0\leq\omega\leq 1$ is a parameter that controls the rate of convergence. For sufficiently small ω, the GLiCD algorithm converges.

3.3. Experimental Setup

This section discusses experimental results obtained by computer simulations. In the simulation, the microphone network consists of 11×11 microphones lying on a 2D rectangular grid, such as that illustrated in FIG. 2. The distance between neighboring microphones is set to 2 meters. It should be noted that the microphone field covers a large region. The simulation then considers the scenario involving one speaker and three noise sources within the microphone field. The locations of the speaker and noise sources are generated randomly, as illustrated in FIG. 2.

Figure 2:
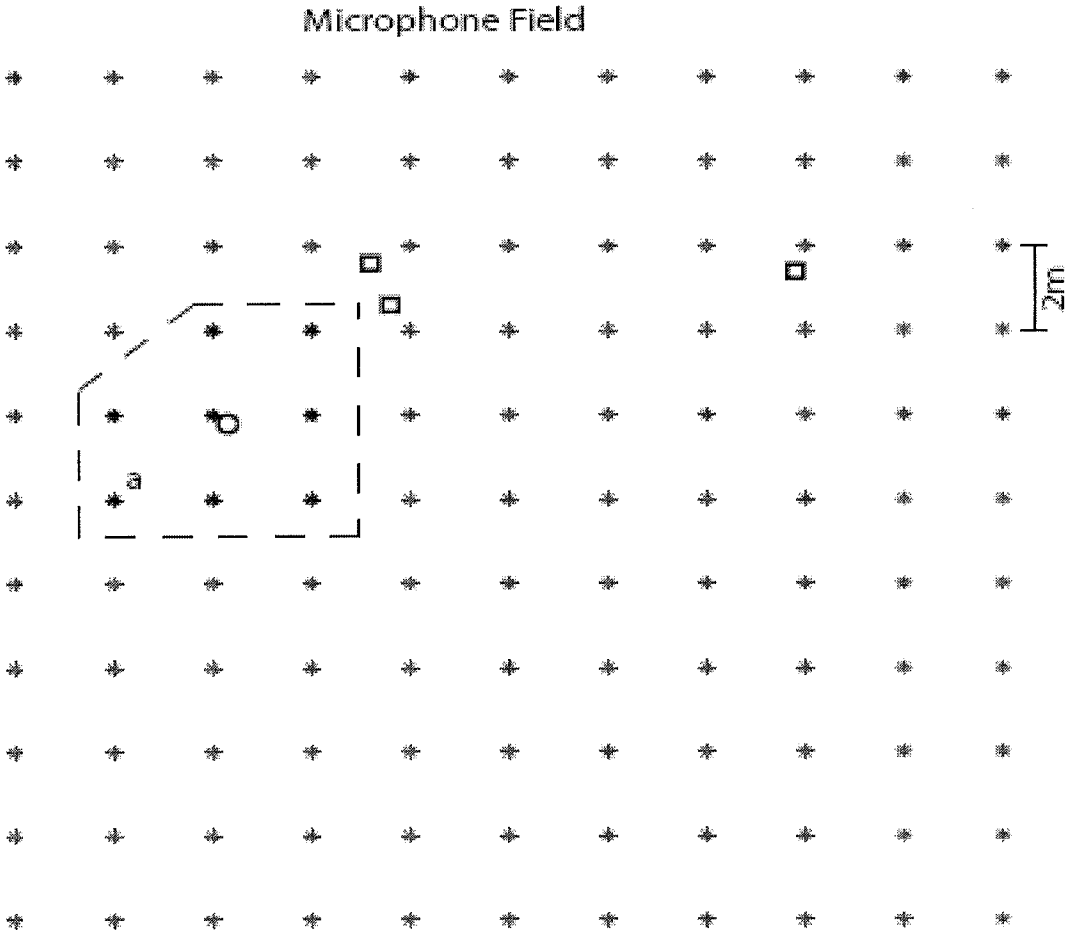
FIG. 2 is a graphical representation illustrating an example microphone network in which one or more embodiments described herein may be implemented.

Referring to FIG. 2, the symbol ○ is used to denote the speaker and to denote the three noise sources. The parameters in the experiment are set as follows. The sampling frequency is $f_s$=16 kHz. Each frame contains 400 samples, corresponding to a speech segment of 25 ms. A 50%-overlapped Hanning window is used. It should be noted that if the relative delay values in d exceed the frame length, the associated frame segments would be misaligned. To avoid this issue, eight microphones are selected around the speaker such that the maximum relative delay value in d is less than 8 ms.

In the experiment, the above operation leads to selecting the eight microphones lying within the shape denoted by dashed lines in FIG. 2. One of the eight microphones lying within the shape is denoted by "a" for reference.

3.4. Simulation Results

The three noise sources illustrated in FIG. 2 are simulated by independent white Gaussian noise sources. The noise correlation matrices $R_N$ for different frequency bins were estimated beforehand. A speech signal of 20 seconds is processed by the GLiCD algorithm. The SNR for microphone a in the network is approximately −11 dB. The eight selected microphones to implement the MVDR beamformer form a fully-connected graph for running the GLiCD algorithm. For each frequency bin within each frame, the iterations of the GLiCD algorithm stop when the maximum difference of two consecutive estimates is less than $10^{-1}$. The parameter ω is empirically chosen to be $$\omega = \min\left(\frac{1}{\|K\|_\infty}, 1\right).$$

Figure 3:
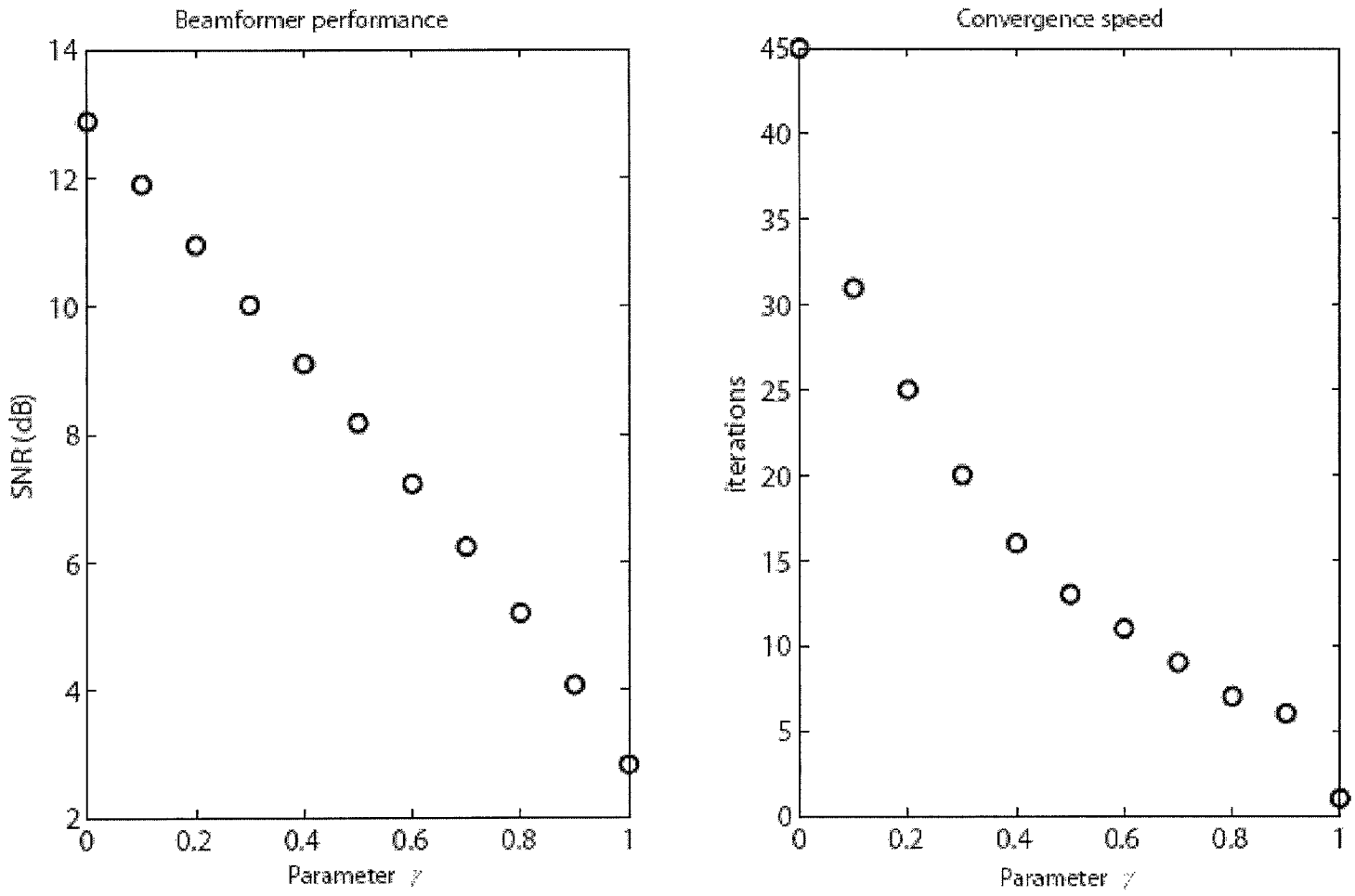
FIG. 3 is a graphical representation illustrating example results of a simulation using a message-passing algorithm according to one or more embodiments described herein.

In the present example, the simulation results for bin 201 are presented in FIG. 3. Other bins show similar behavior. Referring to FIG. 3, the left subplot demonstrates how the output SNR of the beamformer changes as a function of the trade-off parameter γ. The right subplot demonstrates the average number of iterations needed for convergence (only shown for frequency bin 201) as a function of different γ values. It should be noted that as γ increases from 0 to 1, the beamformer performance decreases from that of the MVDR to that of the DSB beamformer. At the same time, the number of iterations decreases with increasing γ values, thereby reducing the transmission power and saving computation time. In practice, the γ value may be adjusted depending on the transmission capacity of the relevant network.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A system comprising:

a plurality of sensors in communication over a network, each of the plurality of sensors includes a communication device to transmit and receive signals and a processor, the processor configured to extract a plurality of signals, acquired by said communication device, from a subset of the sensors, the acquired signals used by said processor to compute parameters of a beam-forming algorithm, wherein the parameters of the beam-forming algorithm are computed in a distributed fashion over the plurality of sensors based on transmission of messages between the plurality of sensors according to a message-passing procedure, wherein the message-passing procedure functions for any topology of the network and the message-passing procedure that functions for any topology of the network is a generalized linear-coordinate descent (GLiCD) algorithm.

2. The system of claim 1, wherein the beam-forming algorithm is a minimum variance distortionless response (MVDR) beam-former.

3. The system of claim 1, wherein the beam-forming algorithm is a delay-sum beam-former.

4. The system of claim 1, wherein the beam-forming algorithm is an algorithm having an adjustable parameter with a continuous range of settings, the continuous range of settings including a minimum variance distortionless response (MVDR) beam-former.

5. The system of claim 4, wherein the continuous range of settings further includes a delay-sum beam-former.

6. The system of claim 4, wherein the adjustable parameter controls a weighting of off-diagonal elements of a sensor noise covariance matrix.

7. The system of claim 1, further comprising a self-calibration component configured to determine locations of the plurality of sensors.

8. The system of claim 1, wherein the plurality of sensors are in one or more predetermined locations.

9. The system of claim 1, wherein the plurality of sensors includes microphones and processors.

10. A method for performing distributed processing across a network of sensors comprising:

extracting, by a processor in each of said plurality of sensors, acquired signals acquired by a communication device in each of said plurality of sensors, from a subset of the sensors; and computing, by said processor, parameters of a beam-forming algorithm using the acquired signals, wherein the parameters of the beam-forming algorithm are computed in a distributed fashion over the plurality of sensors based on transmission of messages between the plurality of sensors according to a message-passing procedure, wherein the message-passing procedure functions for any topology of the network and the message-passing procedure that functions for any topology of the network is a generalized linear-coordinate descent (GLiCD) algorithm.

11. The method of claim 10, wherein the beam-forming algorithm is a minimum variance distortionless response (MVDR) beam-former.

12. The method of claim 10, wherein the beam-forming algorithm is a delay-sum beam-former.

13. The method of claim 10, wherein the beam-forming algorithm is an algorithm having an adjustable parameter with a continuous range of settings, the continuous range of settings including a minimum variance distortionless response (MVDR) beam-former.

14. The method of claim 13, wherein the continuous range of settings further includes a delay-sum beam-former.

15. The method of claim 13, wherein the adjustable parameter controls a weighting of off-diagonal elements of a sensor noise covariance matrix.

16. The method of claim 10, wherein the plurality of sensors are in one or more predetermined locations.

17. The method of claim 10, wherein the plurality of sensors includes microphones and processors.

* * * * *